US007918370B2

(12) United States Patent
Yeh et al.

(10) Patent No.: US 7,918,370 B2
(45) Date of Patent: Apr. 5, 2011

(54) PORTABLE FLUID DELIVERING SYSTEM AND KIT

(75) Inventors: Guan Ting Yeh, Tao Yuan (TW); Hang Fu Wang, Tao Yuan (TW); Chia Yeh Hung, Tao Yuan (TW); Min Hon Rei, Tao Yuan (TW)

(73) Assignee: Green Hydrotec Inc., Tao Yuan (TW)

( * ) Notice: Subject to any disclaimer, the term of this patent is extended or adjusted under 35 U.S.C. 154(b) by 872 days.

(21) Appl. No.: 11/898,759

(22) Filed: Sep. 14, 2007

(65) Prior Publication Data

US 2008/0135580 A1 Jun. 12, 2008

(30) Foreign Application Priority Data

Dec. 8, 2006 (TW) ..... 95146115 A

(51) Int. Cl.
*B67D 7/80* (2010.01)

(52) U.S. Cl. ..... 222/146.2; 222/146.1; 417/207; 417/208; 62/48.1

(58) Field of Classification Search ..... 222/146.5, 222/146.1, 146.2, 386.5, 394; 62/50.2, 48.1; 417/207–208, 118
See application file for complete search history.

(56) References Cited

U.S. PATENT DOCUMENTS

| | | | | |
|---|---|---|---|---|
| 3,648,018 | A * | 3/1972 | Cheng et al. | 392/394 |
| 4,136,721 | A * | 1/1979 | Holmqvist et al. | 141/11 |
| 4,608,831 | A * | 9/1986 | Gustafson | 62/48.1 |
| 5,076,467 | A * | 12/1991 | Sugo | 222/3 |
| 5,460,161 | A | 10/1995 | Englehart et al. | |
| 5,488,831 | A * | 2/1996 | Griswold | 62/48.1 |
| 6,042,342 | A | 3/2000 | Orian | |
| 6,202,707 | B1 * | 3/2001 | Woodall et al. | 141/1 |
| 6,766,817 | B2 | 7/2004 | da Silva | |
| 6,918,404 | B2 | 7/2005 | da Silva | |
| 7,066,586 | B2 | 6/2006 | da Silva | |

FOREIGN PATENT DOCUMENTS

| | | | |
|---|---|---|---|
| JP | 56050505 | A | 4/1981 |
| JP | 59066066 | A | 4/1984 |
| JP | 5258760 | A | 10/1993 |
| JP | 11113629 | A | 4/1999 |
| JP | 2000173632 | A | 6/2000 |
| JP | 2002255507 | A | 9/2002 |
| JP | 2003109633 | A | 4/2003 |
| JP | 200481834 | A | 3/2004 |
| JP | 2005235575 | A | 9/2005 |
| KR | 2000-0048887 | | 7/2000 |

* cited by examiner

*Primary Examiner* — Frederick C. Nicolas

(74) *Attorney, Agent, or Firm* — Tim Tingkang Xia; Morris, Manning & Martin, LLP

(57) ABSTRACT

A portable fluid delivering system is provided. The system comprises a container, a heat source, a flow rate regulating device and a delivery tube. The container has a containing space for a fluid to be delivered, in a liquid state at room temperature. The heat source provides an elevated vapor pressure in the containing space over the fluid to be delivered, whereby the fluid to be delivered is driven at a desirable rate along the delivery tube.

24 Claims, 4 Drawing Sheets

PORTABLE FLUID DELIVERING SYSTEM AND KIT

This application claims the benefit from the priority of Taiwan Patent Application No. 095146115 filed on Dec. 8, 2006, the disclosures of which are incorporated by reference herein in their entirety.

CROSS-REFERENCES TO RELATED APPLICATIONS

Not applicable.

BACKGROUND OF THE INVENTION

1. Field of the Invention

The present invention relates to a fluid delivering system and a fluid delivering kit. In particular, the invention relates to a fluid delivering system and kit which are adapted to deliver small quantities of fluid. The present invention is especially adapted for micro-equipments, such as fuel cells, for providing raw materials during operation.

2. Descriptions of the Related Art

In the chemical industry, fluids are frequently transported. In general, mechanical compression pumps, which have devices with reciprocating, diaphragm pressing, centrifuging or eccentrically rotating, are used as a source of pressure for transporting fluids. The pumps are usually disposed on the upstream end of the tube for elevating the pressure at the upstream end of the tube. The fluid is then delivered to the other end (downstream) of the tube which is at lower pressure. Unfortunately, this kind of system is bulky, noisy and high in energy consumption due to the use of the mechanical compressor pump for raising the pressure and converting electric energy into mechanical energy. Moreover, those pressure pumps always require sealing structures to prevent leakage. Thus, it turns into an issue for using the pumps to provide stable and quantitative delivery of small volume of liquid.

With technique improvements, various application devices have been gradually miniaturized. As a result, fluids need to be delivered in smaller quantities. For example, only a small quantity of methanol or methanol-water is needed for a reaction in a small fuel cell to generate electricity. In this situation, the delivery capability of the conventional mechanical pumps is far beyond the requirements, which is not suitable for delivering fluid in small quantity instead. Furthermore, when high technology products are designed with a lighter weight and slimmer size, the conventional mechanical pumps are too bulky for these products. In addition, conventional mechanical pumps are often fluctuated in volume delivering and energy consuming. Thus, a simple, quiet and low in energy consuming pump which is suitable for delivering small amount of fluids are needed in this field.

Recently, fluid delivering technologies have utilized the capillary action of the fluid to counteract the force of gravity on the fluid. However, the strength of the capillary action is still tied to gravity, surface tension, temperature of the fluid, fluid nature and the transporting environment. Moreover, when the pressure resistance downstream is higher, such as 0.5 to 1 atmospheric pressure or more, the capillary action is insufficient to drive the fluid.

As a result, the development of pumps for overcoming the abovementioned disadvantages of the conventional mechanical pumps in delivering small quantities of fluid becomes a serious challenge. The present invention provides a simple and economical manner to achieve the objective of transporting micro-fluids in a slim device.

SUMMARY OF THE INVENTION

The primary objective of this invention is to provide a fluid delivering system and a fluid delivering kit by using the vapor pressure of fluid as the source of the driving pressure. Vapor pressure is formed by applying a heat source to the system, so that a small quantity of fluids can be delivered.

Another objective of this invention is to provide a fluid delivering system and a fluid delivering kit without any moving component, and hence to achieve a silent delivery mechanism. An auxiliary liquid can be adequately added if necessary to boost up the vapor pressure to overcome potential back pressure resistance in the downstream or to allow a higher pressure operation in the downstream process. The auxiliary liquid is immiscible with the fluid to be delivered (FTBD). Preferably, the auxiliary liquid possesses a boiling point lower than that of the FTBD. Alternatively, the auxiliary liquid and the FTBD can form an azeotrope. Thus, when the heat source is provided, sufficient vapor pressure at a constant magnitude can be generated in the system to overcome the pressure resistance downstream in the tube and to provide constant pressure differential for delivering the fluid stably and steadily.

In comparison with the conventional mechanical pumps, the fluid delivering system and kit of the present invention are portable, slim, stable, quiet and low in energy consumption.

To achieve the abovementioned objectives, a fluid delivering system comprising a container, a heat source, and a delivery tube is provided. The container has a discharging aperture and a containing space for the FTBD, which is in a liquid state at room temperature. The heat source provides an elevated vapor pressure in the containing space by heating the FTBD. The delivery tube includes two ends in which one end connects to the containing space and the other end opens to the outside of the container. Thus, the FTBD partially vaporized in the container by the heat source forms the elevated vapor pressure which drives the FTBD out of the fluid delivering system through the delivery tube.

The present invention further discloses a fluid delivering kit, which comprises a container, a delivery tube and an auxiliary liquid. The auxiliary liquid is immiscible with the FTBD. The auxiliary liquid also possesses a boiling point lower than that of the FTBD or can form an azeotrope with the FTBD to generate the desired vapor pressure at a lower temperature. The auxiliary liquid can be at least partially vaporized in the containing space to form a stable upstream vapor pressure to drive the FTBD.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1A:
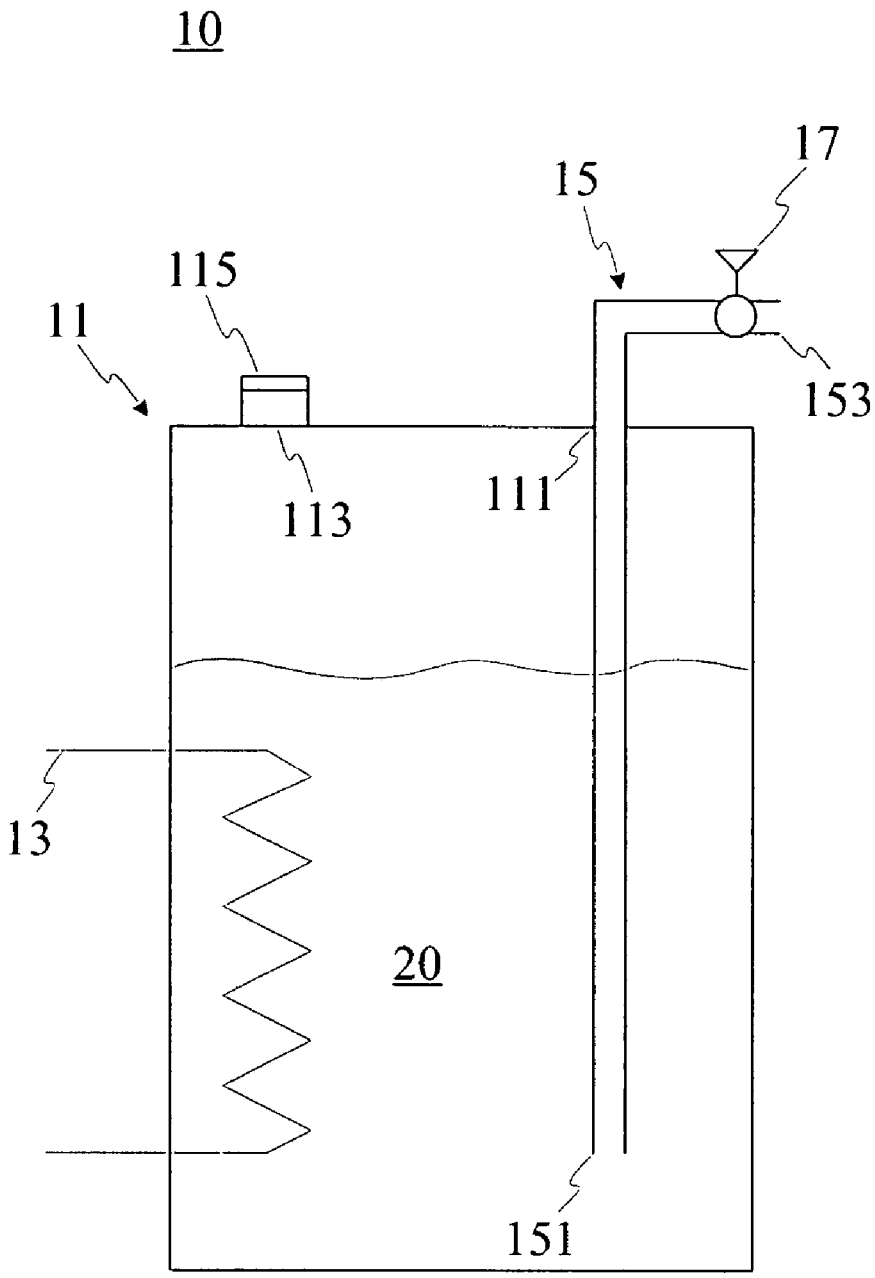
FIG. 1A is a schematic view illustrating a preferred embodiment of the present invention.

The preferred embodiment of the present invention is shown in FIG. 1A. The fluid delivering system 10 mainly comprises a container 11, a heat source 13 and a delivery tube 15. The container 11 has a discharging aperture 111 and a containing space. Preferably, the container 11 is pressure-resistant and corresponds to the operating conditions, such as operation temperature and the various fluids involved. The containing space is used to contain the fluid to be delivered (FTBD) 20 which is going to be delivered. The FTBD 20 is in a liquid state at room temperature. The delivery tube 15 is disposed through the discharging aperture 111. When the fluid delivering system 10 is in operation, the container 11 is substantially sealed, with the exception of the delivery tube 15 which has a pathway leading out of the system. A portion of the FTBD 20 can be delivered out of the fluid delivering system 10 through the delivery tube 15.

Specifically, the delivery tube 15 has a first end 151 and a second end 153 opposite to the first end 151. The first end 151 opens into the bottom of the containing space of the container 11. The FTBD 20 is guided from the first end 151 (the inlet end) through the delivery tube 15 to the second end 153 (the outlet end). Thus, a pathway is provided for the FTBD 20 to be stably discharged under pressure.

The heat source 13 is used to raise the temperature of the fluid, including the delivered FTBD 20, in the container 11 for vaporizing the fluid and providing an elevated vapor pressure in the containing space. The vapor pressure can stably drive the FTBD 20 through the both the delivery tube 15 and discharging aperture 111 and out of the fluid delivering system 10. It is noted that the temperature of the fluid does not to be continuously raised. The heat source only has to maintain the vapor pressure as the source of the driving pressure in the containing space.

In this embodiment, the manner of controlling the flowing speed of fluid delivery not only comprises temperature adjustments, but also uses a control element 17, such as valves, which is disposed on the delivery tube 15. The control element 17 is used to adjust the flowing speed of the FTBD 20 into the delivery tube 15, such as controlling the flowing availability and the flow rate. For example, the control element 17 can be a metering valve, such as a needle valve. When the temperature is raised to a setting temperature, the control element 17 is then actuated to adjust the flow rate. Alternatively, a tubing with a small opening, such as a capillary tube with suitable length, can be used as the delivery tube for simultaneously controlling the flow rate. When the capillary tube is adopted, the control element 17 can be an ON-OFF simple valve.

During the operation, the FTBD 20 is partially vaporized, and a portion of the FTBD 20 in the liquid state is discharged out of the system. Therefore, there are less FTBD 20 in the container 11. For operation convenience in the system 10, the FTBD 20 should be supplied into the container 11. Thus, a filling aperture 113 should be disposed on the container 11. Furthermore, because the fluid delivering system 10 should be substantially sealed during the operation, a cover 115 is disposed to seal the filling aperture 113 if necessary. For example, the container 11 can communicate with a reservoir (not shown in the figures), which is filled with the fluid, through the filling aperture 113. Accordingly, the fluid in the reservoir can be fed into the container 11 by using a simple and cheap pump or with the use of gravitation force from being disposed at a higher place. The reservoir can also be detached from the container 11 when the supplement is accomplished, or be replaced with a fresh one with full volume of the fluid, thus to facilitate supplying the FTBD 20 into the container 11. In this way, the size and cost of the container 11 can be reduced. Since the delivery tube 15 and the filling aperture 113 with the cover 115 are independently disposed on the container 11 as shown in FIG. 1A, the delivery tube 15 can alternatively be disposed on the cover 115 for providing similar benefits. Those skilled in the art should understand without further descriptions.

Figure 2:
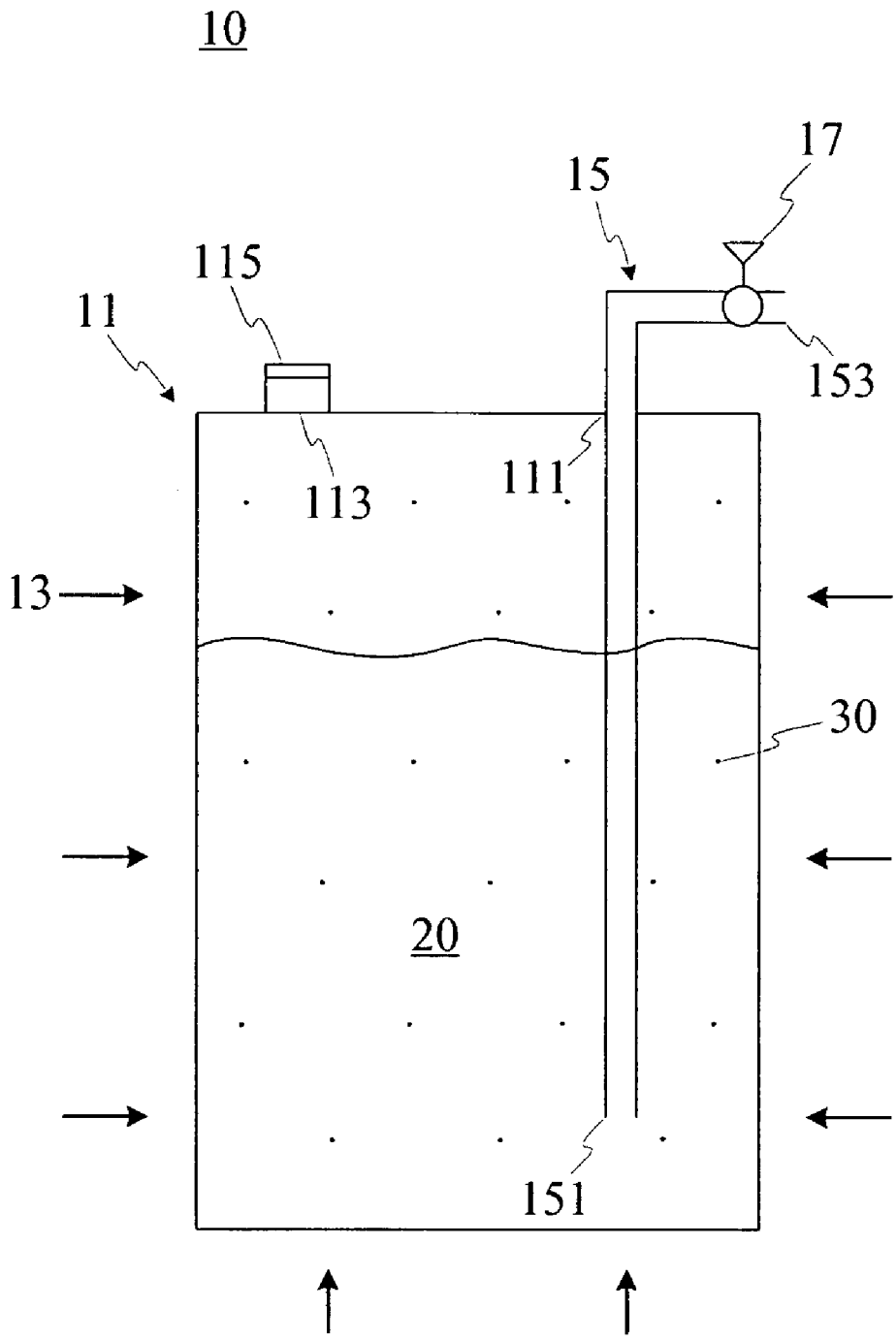
FIG. 2 is a schematic view illustrating another preferred embodiment of the present invention.

The heat source 13 that is directly or indirectly providing heat to the system can vary. The heat source 13 as shown in FIG. 1A directly heats the FTBD 20 whereas the heat source 13 as shown in FIG. 2 indirectly heats the FTBD 20. For example, the heat source 13 can use the surplus heat generated from the adjacent heat generating element. More specifically, as indicated by the arrows shown in FIG. 2, in an indirect heating manner, the heat source 13 heats the container 11 so as to vaporize the FTBD 20 to generate a vapor pressure in the container 11. The heat source 13 can be a high-temperature gas, or even a fluid delivering system 10 disposed in the environment with high temperatures for raising the temperature of the FTBD 20. Thus, the surplus heat or water with high temperature generated from various electric appliances, vehicles or factories, for example, can be reused. Alternatively, the heat source 13 can be selected from a group consisting of thermocouple wires, heating bands, electric heaters, hot baths, hot gases, and combinations thereof, wherein hot gases include the exhausted gases generated during the operation of equipments or the gases generated from chemical reactions. Those skilled in the art can substitute the heat source 13 using any conventional technique that is not limited herein. Thus, the FTBD 20 in the container 11 can be partially vaporized to provide the needed vapor pressure.

In actuality, the heat needed for elevating the vapor pressure is not that much due to the small fluid delivering system 10. For example, heat from an electric apparatus, chemical reactions or combustion can be used to heat the fluid delivering system 10 of the present invention. The FTBD 20 can be, but is not limited to, water, methanol and/or ethanol. The FTBD 20 can also be gasoline or diesel fuel.

Figure 1B:
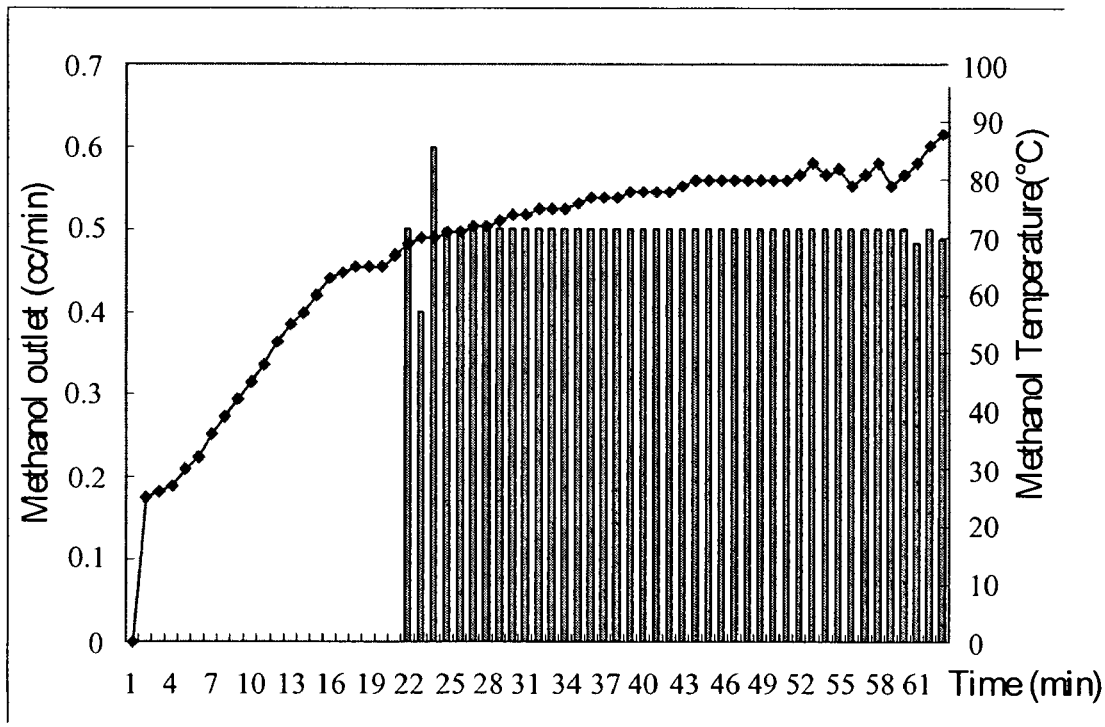
FIG. 1B is a diagram showing the stable fluid delivery in a preferred embodiment of the present invention.

The delivering system of the present invention can be utilized to stably deliver a fluid. A container, having a delivery pipe with a metering valve and containing 100 ml methanol, was disposed in hot baths for being gradually heated, wherein the container was equipped with a thermal couple and a pressure meter for recording the temperature of the methanol and pressure inside the container. The capacity of the container was 160 ml. Referring to FIG. 1B, the curve line presents the temperature of the methanol and the bars presents the flow rate of the discharged methanol. As shown in FIG. 1B, methanol started to be discharged as its temperature was raised above 65° C. When the temperature of methanol was gradually raised, the vapor pressure inside the container was also elevated. With the adjustment of the metering valve, methanol was delivered by the above described fluid delivering system at a rate of approximately 0.5 c.c./min stably and steadily.

Another preferred embodiment of the present invention is shown in FIG. 2. In addition, the auxiliary liquid 30, which is immiscible with the FTBD 20, can be added into the containing space. It is preferred for the auxiliary liquid 30 to possess a boiling point lower than that of the FTBD 20. When the heat source 13 is applied, the temperatures of the FTBD 20 and the auxiliary liquid 30 are raised. Because the auxiliary liquid 30 possesses a lower boiling point, it will be vaporized prior to the FTBD 20 and will elevate the auxiliary vapor pressure in the containing space for delivering the FTBD 20. The auxiliary liquid 30 can boost up the vapor pressure to overcome potential back pressure resistance in the downstream or to allow a higher pressure operation in the downstream process. In choosing the auxiliary liquid 30, the liquid should either have lower boiling point and be immiscible with the FTBD 20 or, preferably, have a gravity smaller than that of the FTBD 20 to float above the FTBD 20 without being delivered along with it. If the gravity of auxiliary liquid 30 is larger than that of the FTBD 20, the inlet end of the delivery tube 15 should be disposed slightly above the bottom of the container 11. Another preferred option for the auxiliary liquid 30 can be one that forms an azeotrope with the FTBD 20. Because the azeotrope has a boiling point lower than that of the FTBD 20 and the auxiliary liquid 30, it will facilitate the formation of vapor pressure in the container 11 for delivering the FTBD 20.

For example, in one situation, an auxiliary liquid 30 with high volatility such as pentane, cyclopentane, hexane, and/or cyclohexane can be adopted, while the FTBD 20 is methanol and/or ethanol. In another situation, an auxiliary liquid such as methanol, isopropanol, and/or dichloromethane can be adopted, while the FTBD 20 is gasoline or diesel fuel. Since the gravity of dichloromethane is larger, the first end 151 of the delivery tube 15 should not be touching the bottom of the container 11 so as to prevent the auxiliary liquid 30 from being discharged out of the system. The following examples illustrate the FTBD 20 and the auxiliary liquid 30 forming an azeotrope:

| the fluid to be delivered (FTBD) | the auxiliary liquid | azeotropic temperature (° C.) |
|---|---|---|
| water ($H_2O$) | pentane ($C_5H_{12}$) | 34.6 |
| methanol ($CH_3OH$) | pentane ($C_5H_{12}$) | 30.9 |
| methanol ($CH_3OH$) | cyclopentane ($C_5H_{10}$) | 38.8 |
| methanol ($CH_3OH$) | hexane ($C_6H_{14}$) | 50.6 |
| methanol ($CH_3OH$) | cyclohexane ($C_6H_{12}$) | 54.2 |

For example, when the FTBD 20 is methanol and the auxiliary liquid 30 is pentamethylene, the azeotropic temperature can be lowered to 38.8° C. Similarly, when the FTBD 20 is methanol and the auxiliary liquid 30 is pentane, the azeotropic temperature can be lowered to 30.9° C. By using the aforesaid azeotropic temperatures that are close to room temperature and are more applicable by applying a general heating manner, the practice threshold can be effectively lowered.

In actuality, due to the slim fluid delivering system 10 of the present invention, only a few of the auxiliary liquid 30 is needed in the containing space of the container 11. In comparison with the quantity of the FTBD 20 in the container 11, the quantity of the added auxiliary liquid 30 is relatively low and does not effect the concentration of the FTBD 20 substantially. For example, assume that a fluid delivering system 10 has a container 11 with a 1 liter containing space, the FTBD 20 is methanol, the auxiliary liquid 30 is pentane ($C_5H_{12}$), and the azeotrope is vaporized to generate a pressure of 2 atmA in the container 11. The azeotrope vapor should approximately be 0.08 mole to fill the containing space at the boiling temperature of the azeotrope (i.e. 30.9° C.) according to the ideal gas equation (PV=nRT). Because methanol is 14.5% of the azeotrope and pentane is 85.5% of the azeotrope, i.e. 0.0684 moles, only about 5 grams of pentane is enough. Furthermore, the vaporized methanol is much less than the total methanol in the container 11, and thus, the contents of the FTBD 20 are not affected when it is mixed. If the containing space is 1 liter and with the consideration that the vapor pressure needs to be higher than 2 absolute atmospheres for delivering the FTBD and a portion of unvaporized auxiliary liquid 30 is inevitably discharged out of the system, the added pentane should approximately be 5 to 10 grams. With respect to a system with the containing space filled with FTBD, pentane is only a very small percentage of the discharged fluid. Furthermore, the formed azeotrope will contain less than 0.37 grams of methanol. In other words, most of the initially added methanol will be no longer remaining in the system.

Other implements derived from the present invention should be part of the general concept of the present invention. For example, another preferred embodiment of the present invention disclosed herein is a fluid delivering kit. The fluid delivering kit comprises the container 11, the delivery tube 15 and the auxiliary liquid 30 described hereinbefore. Upon assembling the parts, the kit can be used to deliver fluids. When the user starts to operate this fluid delivering kit, the auxiliary liquid 30 can be added into the containing space before, simultaneously, or after the FTBD 20 is added into the containing space. After the auxiliary liquid 30 is at least partially vaporized by heating, the auxiliary vapor pressure can be formed in the containing space for providing at least a partial driving pressure to deliver the FTBD.

Similarly, the fluid delivering kit disclosed in this embodiment can also comprise the abovementioned control element 17, filling aperture 113 and cover 115 which are not further described herein.

For verifying the effects of the present invention, a simple experiment was performed as follows. A pot made of stainless steel with an outer diameter of 60 mm, and a height of 75 mm was filled with 120 milliliter of water and was be disposed in a sink as a hot bath. The pot was also disposed with a pressure gauge, a thermometer, and a 1/16 inch capillary outlet for measuring fluid delivery.

First, the system was heated from room temperature. The measured temperature, pressure and flowing variation was shown in Table 1. As the result, when the temperature was at 88° C., the pressure was at 1.7 atmA. At the same time, the fluid flow rate from the pot was about 0.32 grams per minute.

Moreover, another similar experiment was conducted. This time, the pot was filled with 120 milliliter of water, with 1 milliliter of pentane as the auxiliary liquid. Similarly, the system was heated from room temperature with being measured in temperature, pressure and flowing variation. As a result, when the water temperature was 46° C., the vapor pressure was 1.7 atmA. The fluid flowing rate from the pot was about 0.33 grams per minute. Likewise, when the water temperature was at 70 degrees centigrade, the vapor pressure was 2.5 atmA and the fluid flowing rate was about 0.79 grams per minute. In all cases, a micro-delivery needs not a very high temperature, and the delivering efficiency can be enhanced with the addition of little amount of adequate auxiliary liquid.

TABLE 1

| water (120 c.c.) | | | water (120 c.c.) + pentane (1 cc) | | |
|---|---|---|---|---|---|
| temperature (° C.) | pressure (atmA) | flow rate (g/min) | temperature (° C.) | pressure (atmA) | flow rate (g/min) |
| 40 | 1.0 | — | 29 | 1.1 | — |
| 55 | 1.1 | — | 33 | 1.3 | — |
| 61 | 1.2 | — | 36 | 1.5 | — |
| 68 | 1.3 | — | 46 | 1.7 | 0.33 |
| 72 | 1.4 | — | 50 | 1.9 | — |

TABLE 1-continued

| water (120 c.c.) | | | water (120 c.c.) + pentane (1 cc) | | |
|---|---|---|---|---|---|
| temperature (° C.) | pressure (atmA) | flow rate (g/min) | temperature (° C.) | pressure (atmA) | flow rate (g/min) |
| 75 | 1.5 | — | 56 | 2.1 | 0.60 |
| 83 | 1.6 | — | 63 | 2.3 | — |
| 88 | 1.7 | 0.32 | 70 | 2.5 | 0.79 |

According to the abovementioned fluid delivering system, kit and method for enhancing the fluid delivery, either the vapor pressure elevated by the fluid itself or a vapor pressure generated from an auxiliary liquid added thereto can drive the FTBD after the fluid is heated. The present invention is especially suitable for deliver fluids in micro-quantities. The present invention can deliver a micro-quantity of FTBD with the use of heat available from the environment and without the need of an additional pump. The product of the present invention is portable, slim, consumes little energy and is suitable for many applications in liquid delivery.

Figure 3:
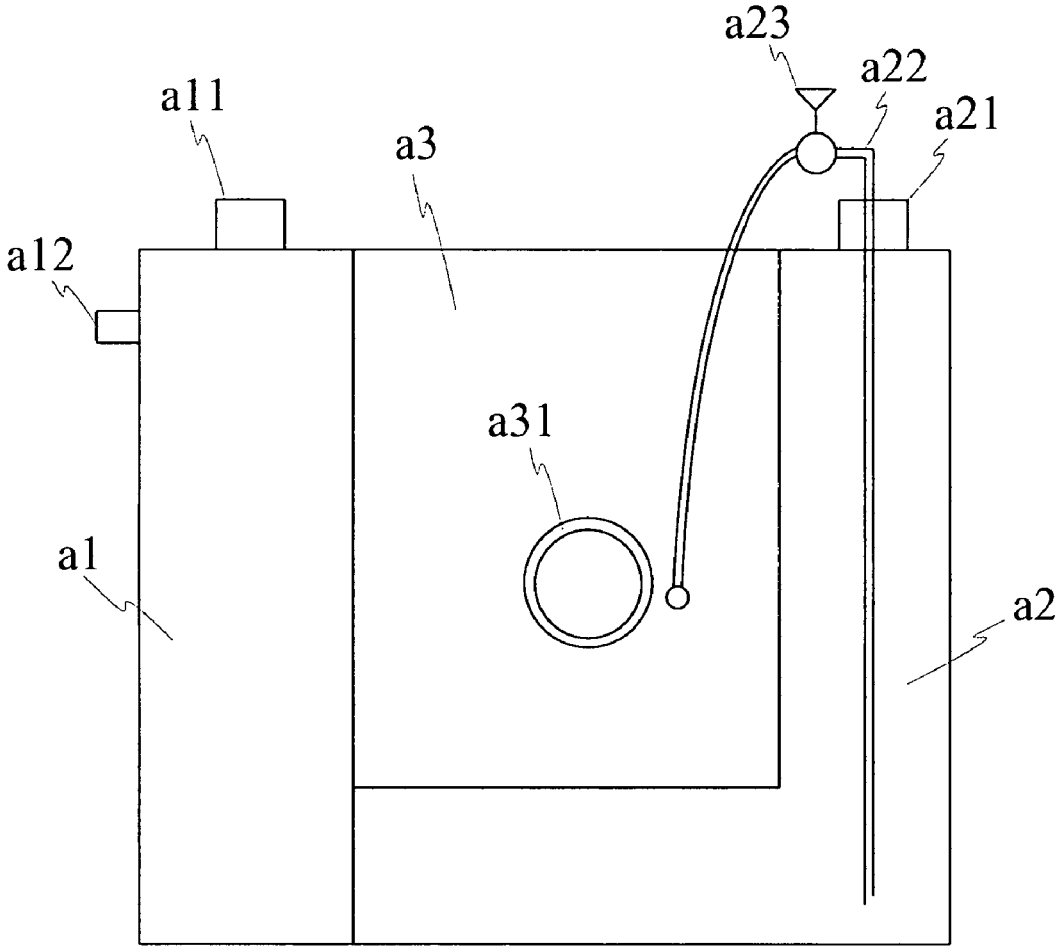
FIG. 3 is a schematic view illustrating a hydrogen-oxygen fuel cell using the present invention.

FIG. 3 shows the structure of a hydrogen generator of a hydrogen fuel cell applying the present invention for delivering methanol-water to generate hydrogen. In FIG. 3, a methanol container a1, a methanol-water container a2, and a reaction zone a3 are illustrated. The methanol container a1 further comprises a methanol filling assembly (including a filling aperture and a cover), while the methanol-water container a2 further comprises a methanol-water filling assembly (including a filling aperture and a cover). A methanol-water delivering tube a22 is disposed to connect the methanol-water container a2 and the reaction zone a3. A needle valve a23 is further disposed on the methanol-water delivering tube a22.

In this embodiment, air can be introduced into the methanol container a1 through the air inlet a12 by a micro-compressor or a blower (not shown in the figures). Subsequently, methanol is carried into the oxidation catalyst a31 to perform an oxidation-combustion reaction. The heat generated from the reaction can not only raise the temperature of the reaction zone a3 but also raise the temperature of the methanol-water container a2. Thus, vapor pressure is elevated in the methanol-water container a2 to deliver the methanol-water from the methanol-water container a2 to the reaction zone a3 through the methanol-water delivering tube a22 and the needle valve a23. The methanol-water then performs a steam reforming reaction in the reaction zone a3, and generates hydrogen for the fuel cell. When the hydrogen fuel cell is applied to electric products, such as laptops, the abovementioned micro-compressor or the blower can use the existing facilities in the electric products. Thus, a small quantity of methanol-water can be stably delivered without additional pumps.

The performing results of the assembly shown in FIG. 3 are illustrated as below. For portability, the system was designed in a size of only 1000 cubic centimeters, i.e., of the same volume as a cube with 10 cm edges. Heat generated from the methanol oxidation-combustion raised the temperature of the reaction zone a3 from room temperature to 260 degrees centigrade in approximate 5 minutes, and raised the temperature of methanol-water container a2 as well. When the temperature of the reaction zone a3 reached the reaction temperature, the needle valve a23 was adjusted to control the flow rate of the methanol-water to the reaction zone a3 for generating hydrogen.

1. Temperature raising period in the reaction zone: 5 minutes (to 280° C.);
2. Methanol-water consumption: 0.36 gram/minute;
3. Methanol consumption in initial: 0.05 gram/minute;
4. Initial temperature of the methanol-water container: 47° C.;
5. Operating temperature and pressure of the methanol-water container: 62° C., 7 psig;
6. Water/methanol (mole ratio) in the methanol-water container=1.2
7. Yield of hydrogen: 30 liter/hour
8. Product combination in the reaction zone: as shown in Table 2.

TABLE 2

| | methanol-water | reforming products composition (%) | | |
|---|---|---|---|---|
| temperature (° C.) | converting ratio (%) | $H_2$ | CO | $CO_2$ |
| 280 | 100% | 75.17 | 0.89 | 23.94 |
| 290 | 100% | 73.99 | 1.43 | 24.59 |

The above disclosure is related to the detailed technical contents and inventive features of the present invention. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A fluid delivering system, comprising:

a container, having a discharging aperture and a containing space for a fluid to be delivered, which is in liquid state at room temperature;

an auxiliary liquid in the containing space, wherein the auxiliary liquid is immiscible with the fluid to be delivered;

a heat source for providing an elevated vapor pressure in the containing space by heating the fluid to be delivered and the auxiliary liquid; and a delivery tube connecting to the container at the aperture, including a first end open to the containing space and a second end open to the outside of the container;

whereby the elevated vapor pressure drives the fluid to be delivered out the fluid delivering system through the delivery tube.

2. The fluid delivering system as claimed in claim 1, further comprising a control element disposed between the first end and the second end of the delivery tube, to control the fluid delivery at the second end.

3. The fluid delivering system as claimed in claim 2, wherein the control element is a metering valve.

4. The fluid delivering system as claimed in claim 2, wherein the delivery tube is a capillary tube and the control element is a simple valve.

5. The fluid delivering system as claimed in claim 1, wherein the container further comprises a filling aperture for introducing the fluid to be delivered into the container space.

6. The fluid delivering system as claimed in claim 5, further comprising a cover fitting with the filling aperture, whereby the cover seals with the filling aperture during the operation of the fluid delivering system.

7. The fluid delivering system as claimed in claim 1, wherein the container communicates with a reservoir through the filling aperture and the reservoir contains the fluid to be delivered.

8. The fluid delivering system as claimed in claim 1, wherein the heat source is selected from a group consisting of thermocouple wire, heating band, electric heater, hot bath, hot gas, and combinations thereof.

9. The fluid delivering system as claimed in claim 8, wherein the heat source is a hot vapor from a chemical reaction.

10. The fluid delivering system as claimed in claim 1, wherein the fluid to be delivered is selected from a group consisting of water, methanol, ethanol and combinations thereof.

11. The fluid delivering system as claimed in claim 1, wherein the auxiliary liquid possesses a boiling point lower than that of the fluid to be delivered.

12. The fluid delivering system as claimed in claim 1, wherein the auxiliary liquid and the fluid to be delivered can form into an azeotrope.

13. The fluid delivering system as claimed in claim 1, wherein the fluid to be delivered is selected from a group consisting of water, methanol, ethanol and combinations thereof, and the auxiliary liquid is selected from a group consisting of pentane, cyclopentane, hexane, cyclohexane, and combinations thereof.

14. The fluid delivering system as claimed in claim 1, wherein the fluid to be delivered is gasoline or diesel fuel, and the auxiliary liquid is selected from a group consisting of methanol, isopropanol, dichloromethane, and combinations thereof.

15. A fluid delivering kit, comprising:

a container, having a discharging aperture and a containing space;

a delivery tube connecting to the container at the discharging aperture, including a first end open to the containing space and a second end open to the outside of the container; and an auxiliary liquid, possessing a boiling point lower than that of a fluid to be delivered and being immiscible with the fluid to be delivered;

wherein the auxiliary liquid provides an auxiliary vapor pressure in the containing space during the operation of the fluid delivering kit.

16. The fluid delivering kit as claimed in claim 15, wherein the boiling point of the auxiliary liquid is relatively low corresponding to the fluid to be delivered.

17. The fluid delivering kit as claimed in claim 15, wherein the auxiliary liquid and the fluid to be delivered can form into an azeotrope.

18. The fluid delivering kit as claimed in claim 15, further comprising a control element disposed between the first end and the second end of the delivery tube.

19. The fluid delivering kit as claimed in claim 18, wherein the control element is a metering valve.

20. The fluid delivering kit as claimed in claim 18, wherein the delivery tube is a capillary and the control element is a simple valve.

21. The fluid delivering kit as claimed in claim 15, wherein the container further comprises a filling aperture and a cover, wherein the filling aperture is for introducing the fluid to be delivered into the containing space and the cover fits with the filling aperture.

22. The fluid delivering kit as claimed in claim 21, wherein the container communicates with a reservoir through the filling aperture and the reservoir contains the fluid to be delivered.

23. The fluid delivering kit as claimed in claim 15, wherein the fluid to be delivered is selected from a group consisting of water, methanol, ethanol and combinations thereof, and the auxiliary liquid is selected from a group consisting of pentane, cyclopentane, hexane, cyclohexane, and combinations thereof.

24. The fluid delivering kit as claimed in claim 15, wherein the fluid to be delivered is gasoline or diesel fuel, and the auxiliary liquid is selected from a group consisting of methanol, isopropanol, dichloromethane, and combinations thereof.

* * * * *